US005462025A

United States Patent [19]

Israel et al.

[11] Patent Number: 5,462,025

[45] Date of Patent: Oct. 31, 1995

[54] HYDRAULIC CIRCUITS FOR COMPRESSION RELEASE ENGINE BRAKES

[75] Inventors: Mark Israel, Amherst, Mass.; Neil E. Fuchs, New Hartford, Conn.

[73] Assignee: Diesel Engine Retarders, Inc., Wilmington, Del.

[21] Appl. No.: 314,413

[22] Filed: Sep. 28, 1994

[51] Int. Cl.[6] ..... F02D 13/04

[52] U.S. Cl. ..... 123/321

[58] Field of Search ..... 123/321, 320, 123/322, 90.12, 90.15, 90.16

[56] References Cited

U.S. PATENT DOCUMENTS

| | | | |
|---|---|---|---|
| Re. 33,052 | 9/1989 | Meistrick et al. | 123/321 |
| 3,220,392 | 11/1965 | Cummins | 123/97 |
| 3,405,699 | 10/1968 | Laas | 123/97 |
| 4,398,510 | 8/1983 | Custer | 123/90.16 |
| 4,399,787 | 8/1983 | Cavanagh | 123/321 |
| 4,706,625 | 11/1987 | Meistrick et al. | 123/321 |
| 5,105,782 | 4/1992 | Meneely | 123/321 |
| 5,161,501 | 11/1992 | Hu | 123/324 |
| 5,186,141 | 2/1993 | Custer | 123/321 |
| 5,201,290 | 4/1993 | Hu | 123/321 |
| 5,357,926 | 10/1994 | Hu | 123/321 |

*Primary Examiner*—Raymond A. Nelli

*Attorney, Agent, or Firm*—Fish & Neave; Robert R. Jackson

[57] ABSTRACT

The relatively complex and expensive "control valves," which are conventionally used in certain compression release engine brakes for such purposes as filling, isolating, and venting the high pressure portions of the hydraulic circuits in the engine brake, are eliminated and more direct means are provided for performing these functions. In brakes having a mechanism for resetting each slave piston, the high pressure portion of the circuit is filled through a selectively openable aperture in the slave piston. In brakes having a mechanism for automatically adjusting slave piston lash or for limiting ("clipping") the forward stroke of the slave piston, high pressure circuit fill is provided through a simple check valve. In systems in which hydraulic fluid is temporarily displaced from the high pressure circuit, a simple accumulator is provided to store hydraulic fluid for quick refill. A single such accumulator may replace multiple control valves.

19 Claims, 5 Drawing Sheets

FIG. 5
PRIOR ART
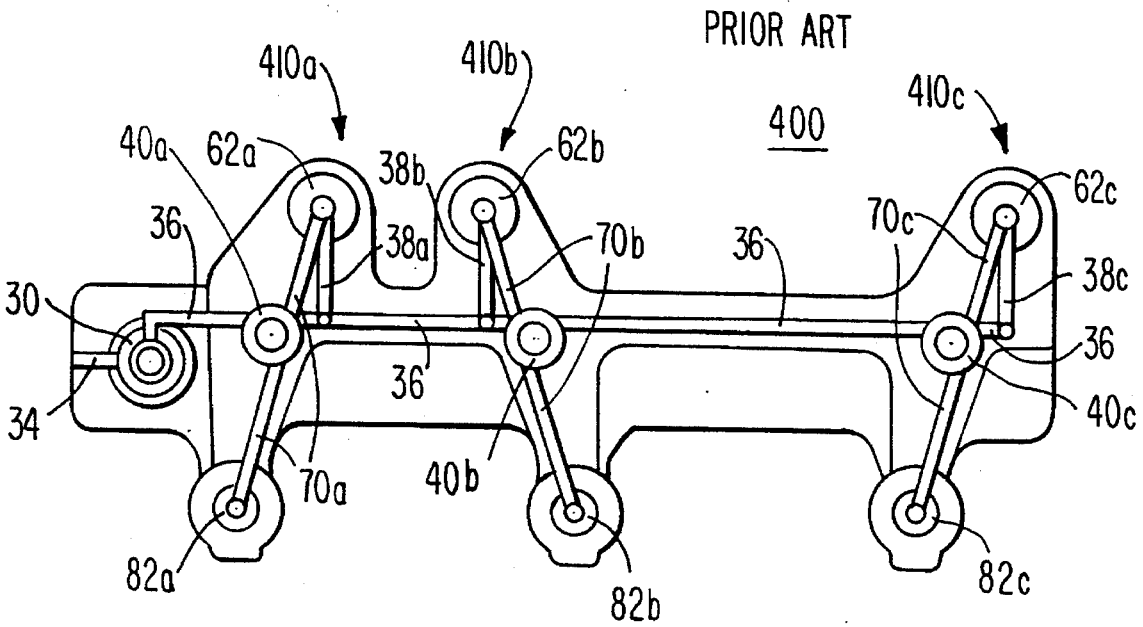
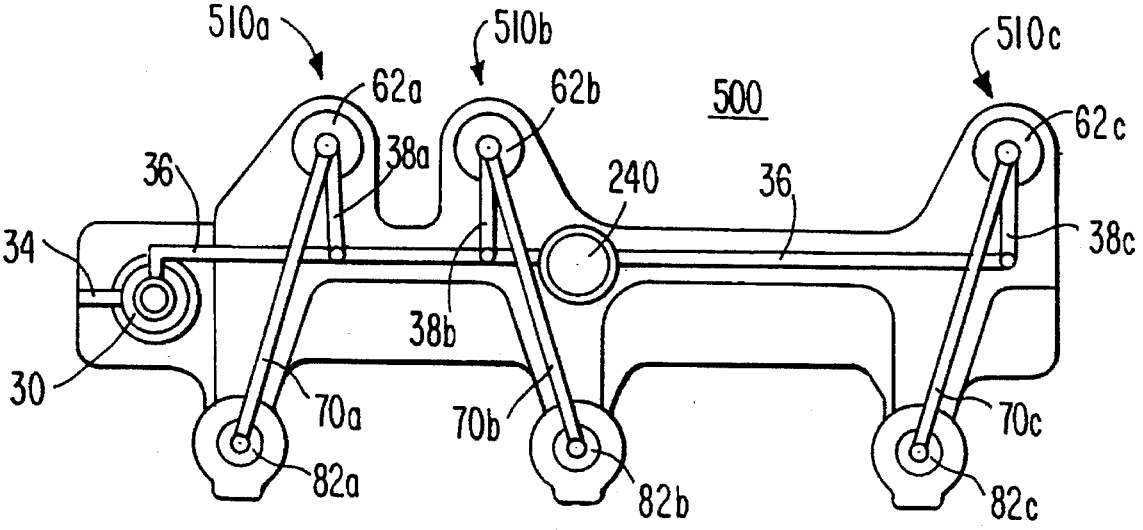
FIG. 6

HYDRAULIC CIRCUITS FOR COMPRESSION RELEASE ENGINE BRAKES

BACKGROUND OF THE INVENTION

This invention relates to compression release engine brakes, and more particularly to simplified hydraulic circuits for such apparatus.

An illustrative portion of a conventional compression release engine brake 10 of the general type shown in such references as Cavanagh U.S. Pat. No. 4,399,787, Meistrick et al. U.S. Pat. No. 4,706,625, and Hu U.S. Pat. No. 5,201,290 (all incorporated by reference herein) is shown in FIG. 1. When the driver of the vehicle equipped with engine brake 10 wants the engine brake to operate, the driver closes vehicle dashboard switch 12 while fuel supply switch 14 is closed (signalling that the fuel supply to the internal combustion engine 100 associated with the engine brake is turned off) and while clutch switch 16 is also closed (signalling that the vehicle's drive train clutch is engaged).

When all of switches 12, 14, and 16 are thus closed, solenoid valve 30 is energized by current flow from vehicle battery 20 through fuse 22 and the above-mentioned switches. (Diode 24 helps prevent arcing when either of switches 14 and 16 opens.) When thus energized, solenoid valve 30 allows hydraulic fluid (typically engine lubricating oil) to flow through check valve 32 and conduit 34 into conduit 36. The hydraulic fluid in conduits 34 and 36 is generally at a relatively low pressure supplied by the lubricating oil circulating system of the engine. This relatively low pressure is sufficient to raise the spool 42 of control valve 40 to the position shown in FIG. 1 and to open the check valve 44 in that spool, as is also shown in FIG. 1. This allows low pressure hydraulic fluid to flow into conduit 50, slave piston cylinder 60, conduit 70, and master piston cylinder 80.

Before the engine brake is turned on, master piston return spring 84 holds master piston 82 up out of contact with the rocker lever linkage 110 that is disposed below master piston 82. (Rocker lever linkage 110 can be any suitable part of internal combustion engine 100 such as a fuel injector activating mechanism, an intake valve opening mechanism, or an exhaust valve opening mechanism of the engine.) However, when low pressure hydraulic fluid is supplied to master piston cylinder 80 as described in the preceding paragraph, the pressure of that fluid is sufficient to overcome the force of relatively weak spring 84, thereby forcing master piston 82 out into contact with rocker lever linkage 110 as shown in FIG. 1. Thereafter, each upward reciprocation of rocker lever linkage 110 causes master piston 82 to move upwardly, which causes a downward stroke of slave piston 62. Each downward stroke of slave piston 62 causes the slave piston to open at least one exhaust valve 120 in the engine cylinder associated with the slave piston. The timing of the upward strokes of rocker lever linkage 110 is such that exhaust valve 120 opens near top dead center of each compression stroke of the engine cylinder served by the exhaust valve. Accordingly, air compressed in that engine cylinder is released to the exhaust system of the vehicle and the engine does not recover the work of compressing that air during each subsequent "power" or expansion stroke of the engine cylinder. The engine therefore absorbs much more kinetic energy from the associated vehicle than it otherwise would, and the effectiveness of the engine in holding back or slowing down the vehicle is greatly increased. This prolongs the life of the vehicle's wheel brakes and improves vehicle operating safety.

The engine brake shown in FIG. 1 includes a so-called "reset" feature like that shown in above-mentioned Cavanagh U.S. Pat. No. 4,399,787. In particular, slave piston return stop screw 90 contains a vertically reciprocable plunger (not visible in FIG. 1, but an analogous plunger 224 is shown in FIG. 3 and described in more detail below). The bottom of the plunger initially covers the upper end of a vertical passageway 64*a* in slave piston 62. The lower end of passageway 64*a* communicates with a transverse passageway 64*b* in the slave piston. Transverse passageway 64*b* communicates with a branch 38 of conduit 36.

During each downward stroke of slave piston 62, the plunger in screw body 90 initially follows the slave piston down, thereby keeping passageway 64*a* closed. However, when the pressure in slave piston cylinder 60 drops to a certain level (because exhaust valve 120 has opened and the pressure in the associated engine cylinder has accordingly decreased), the plunger in screw body 90 is raised by an associated spring (not shown in FIG. 1 but analogous to spring 232 in subsequently described FIG. 3). This allows relatively high pressure hydraulic fluid to flow from slave piston cylinder 60 via passageway 64*a/b*, thereby allowing exhaust valve return spring(s) 122 and slave piston return springs 66 to produce a return stroke of slave piston 62. Such resetting of slave piston 62 prior to the return stroke of master piston 82 may be desirable for such purposes as ensuring that exhaust valves 120 are closed when the normal exhaust valve opening mechanism 130 of engine 100 next produces an exhaust valve opening. This avoids abrupt discontinuities in exhaust valve motion that could result from operation of mechanism 130 while exhaust valves 120 are already somewhat open due to downward displacement of slave piston 62.

The high pressure hydraulic fluid that escapes from the master piston/slave piston ("MP/SP") circuit when passageway 64*a/b* opens is accumulated under control valve spool 42, which is consequently displaced upwardly from the position shown in FIG. 1. This additional upward motion of spool 42 further compresses spring 46 and also compresses much stronger spring 48 in control valve 40. When master piston 82 subsequently performs its return stroke, the accumulated hydraulic fluid is immediately returned to the MP/SP circuit as a result of springs 46 and 48 forcing spool 42 down to the position shown in FIG. 1 and the concurrent opening of check valve 44.

When compression release engine braking is no longer desired, the driver of the vehicle opens switch 12. This de-energizes solenoid valve 30, thereby allowing hydraulic fluid to drain from conduit 36 via the bottom of the solenoid valve. When conduit 36 is thus de-pressurized, spring 46 urges control valve spool 42 down. This allows the MP/SP circuit to vent over the top of spool 42. With the MP/SP circuit thus vented, spring 84 can raise master piston 82 out of contact with rocker lever linkage 110. All compression release engine brake operations therefore cease.

Several variations of the apparatus shown in FIG. 1 are known. For example, above-mentioned Meistrick et al. U.S. Pat. No. 4,706,625 shows apparatus in which the slave piston reset mechanism is combined with a mechanism for automatically adjusting the "lash" (i.e., the cold-engine clearance C between the slave piston and the engine mechanism on which the slave piston acts during engine braking). Another known variation is the so-called "clip valve" which limits the downward stroke of the slave piston (e.g., by releasing high pressure hydraulic fluid as through passageway 64*a/b* after the slave piston has travelled down a predetermined amount). A form of such a clip valve is shown in above-mentioned Hu U.S. Pat. No. 5,201,290. Except for modifications of elements 62 and 90 (or modifications in the vicinity of those elements), all of these variations are typically constructed in the general way shown in FIG. 1.

From the foregoing it will be seen that, in systems of the various types described above, control valve 40 performs a relatively large number of functions. These are (1) providing a passageway for filling the MP/SP circuit, (2) isolating the MP/SP circuit from the low pressure portion of the circuit (e.g., conduit 36) during braking, (3) exhausting the MP/SP circuit when braking is no longer desired, (4) setting the minimum oil pressure in the MP/SP circuit for brake operation (i.e., as a result of the preload force in the spring of check valve 44 and in spring 46), (5) preventing premature movement of the slave piston (i.e. by movement of spool 42 up from the position shown in FIG. 1 to disconnect conduit 36 from conduit 50 in the event of excessive hydraulic pressure in conduit 36), and (6) accumulating hydraulic fluid temporarily displaced from the MP/SP circuit (e.g., when the above-described slave piston reset or clip valve operation occurs).

Control valve 40 is a relatively complex and expensive component of the engine brake. Moreover, the typical engine brake requires several such control valves. The control valves also tend to be a major contributor to high pressure leakage because high pressure hydraulic fluid from the MP/SP circuit can leak both upwardly and downwardly past spool 42 when it is in the position shown in FIG. 1. Such leakage tends to decrease the efficiency of motion transfer from the master piston to the slave piston.

In view of the foregoing, it is an object of this invention to improve and simplify the hydraulic circuitry of compression release engine brakes.

It is a more particular object of this invention to eliminate the control valves employed in compression release engine brakes such as those described above, while maintaining all the functionality provided by such valves.

SUMMARY OF THE INVENTION

These and other objects of the invention are accomplished in accordance with the principles of the invention by replacing the conventional control valves in compression release engine brakes with simpler and more direct means for filling, isolating, and venting the high pressure MP/SP hydraulic circuits in the brakes. In brakes having a mechanism for resetting the slave piston, each MP/SP circuit is filled with hydraulic fluid through a selectively openable aperture in the associated slave piston. In brakes having (1) mechanisms for automatically reducing slave piston lash during operation of the engine brake, or (2) mechanisms for limiting the total motion of the slave pistons, each MP/SP circuit is filled with hydraulic fluid through a simple check valve. In systems where hydraulic fluid is temporarily displaced from the MP/SP circuits (e.g., during reset or clip valve mechanism operation), a simple hydraulic fluid accumulator is used to store that hydraulic fluid for quick refill of the MP/SP circuits. Moreover, one such accumulator may serve several MP/SP circuits in the brake, thereby making it possible to replace several control valves with a single accumulator.

Further features of the invention, its nature and various advantages will be more apparent from the accompanying drawings and the following detailed description of the preferred embodiments.

BRIEF DESCRIPTION OF THE DRAWINGS

FIG. 5 is a schematic plan view of typical prior art engine brake apparatus for serving several cylinders of an associated internal combustion engine.

FIG. 6 is a view similar to FIG. 5 showing how the apparatus of FIG. 5 can be modified in accordance with the present invention.

DETAILED DESCRIPTION OF THE PREFERRED EMBODIMENTS

Figure 1:
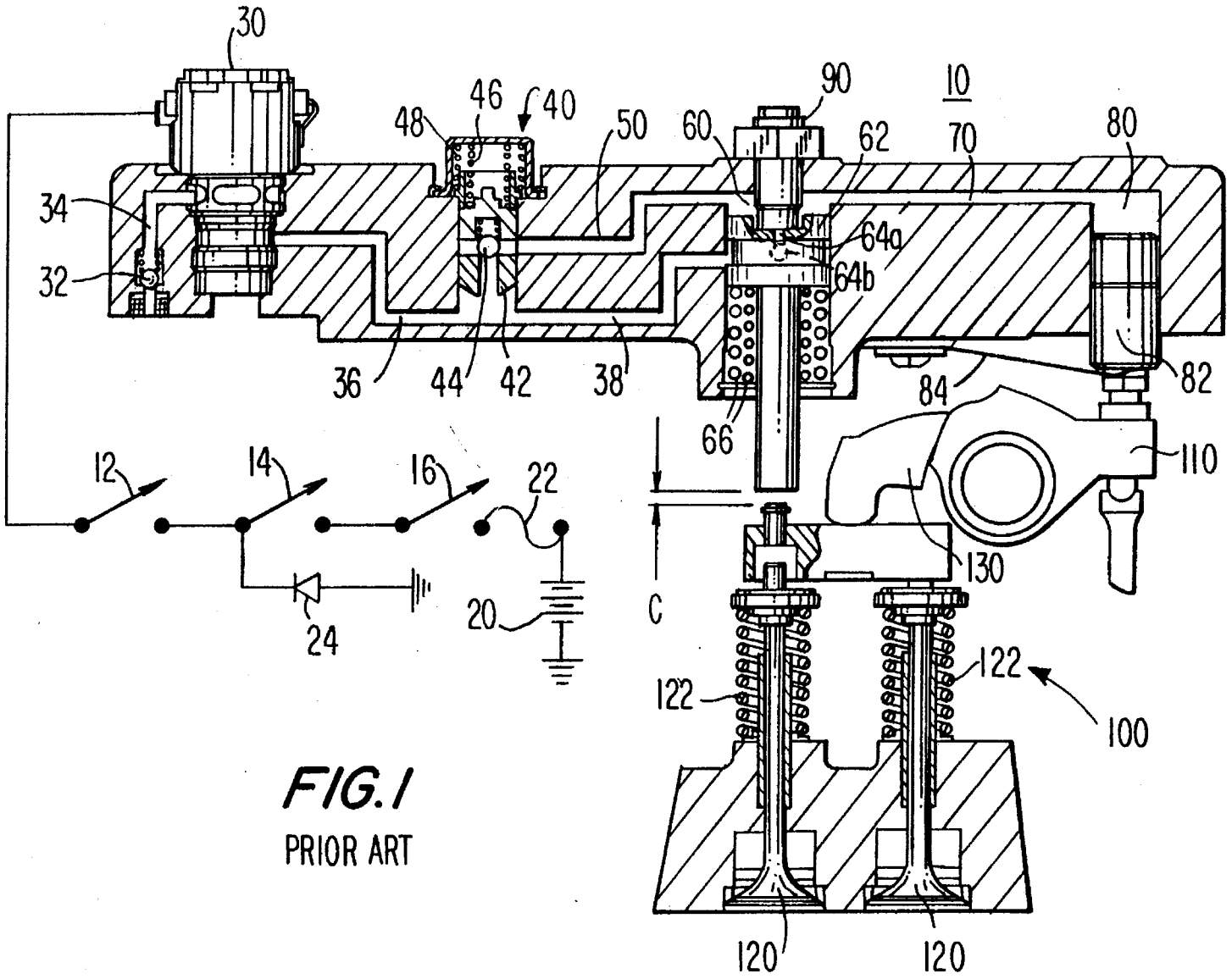
FIG. 1 PRIOR ART
FIG. 1 is a simplified sectional view of an illustrative portion of a typical prior art compression release engine brake. Portions of a conventional internal combustion engine associated with the engine brake are also shown in FIG. 1, as is a simplified schematic diagram of a conventional control circuit for the engine brake.
Figure 2:
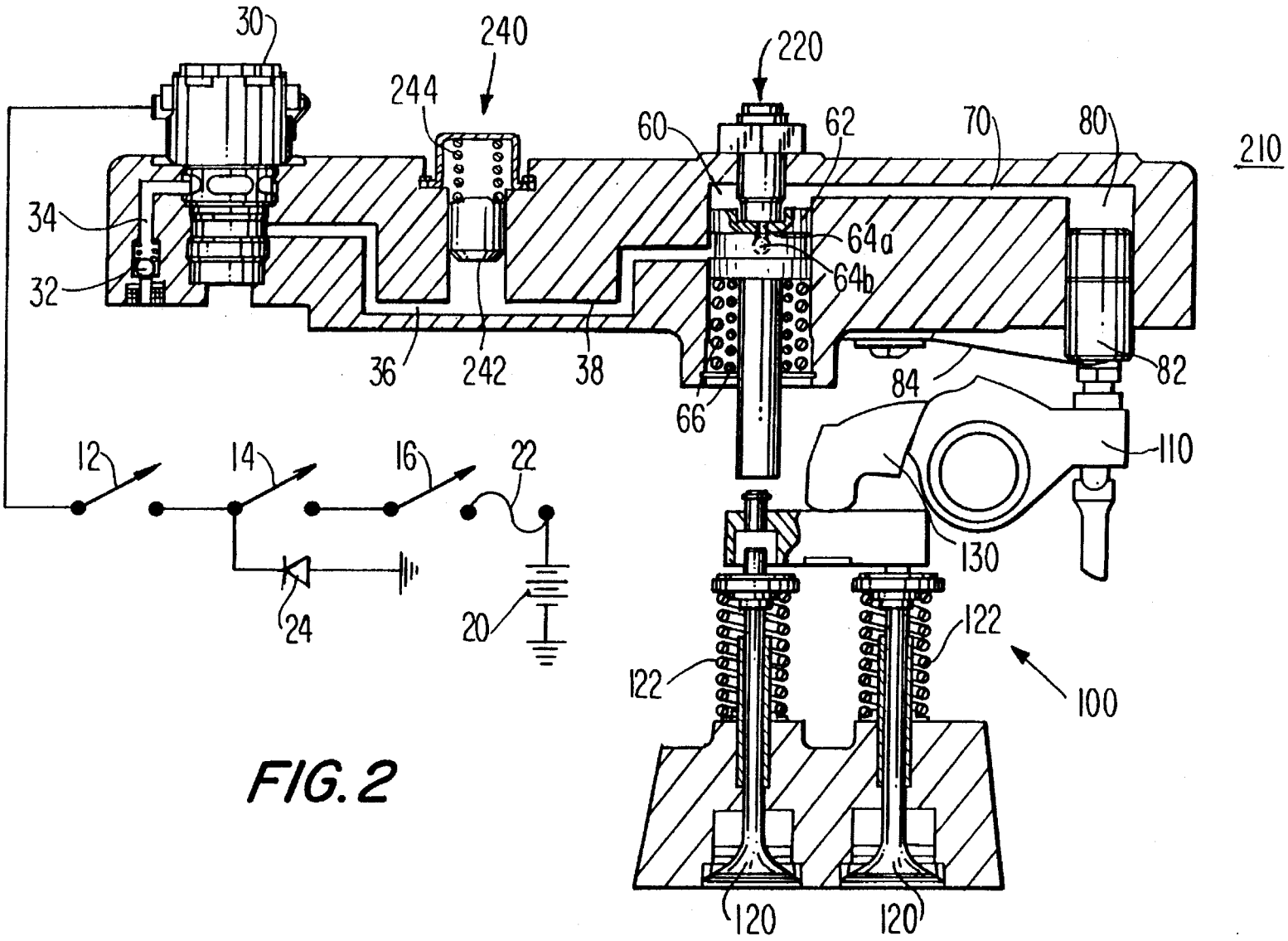
FIG. 2 is a view similar to FIG. 1 showing a first illustrative embodiment of the invention.
Figure 3:
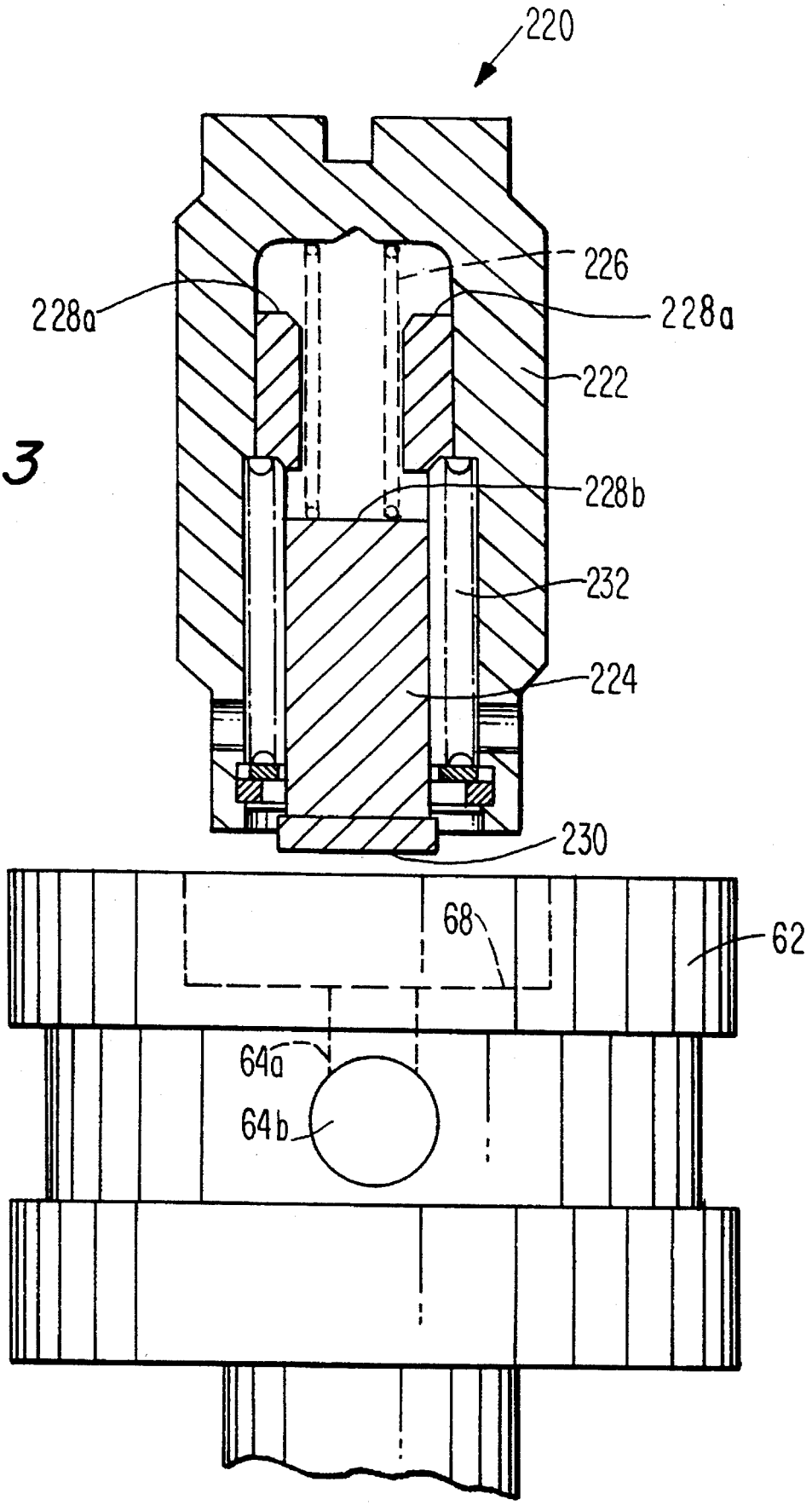
FIG. 3 is an enlarged, partly sectional view of portions of the apparatus shown in FIG. 2.

FIGS. 2 and 3 show a first illustrative embodiment of the invention in which the engine brake is equipped with a slave piston reset mechanism that is not combined with an automatic lash adjustment mechanism. Elements in FIGS. 2 and 3 that are the same as or substantially similar to elements shown in FIG. 1 have the same reference numbers used in FIG. 1. These elements will not be described again in detail. Elements in FIGS. 2 and 3 that are new or significantly different from anything shown in FIG. 1 have reference numbers in the 200 series in FIGS. 2 and 3. This discussion will focus on these new or significantly different elements.

In accordance with this invention, the reset mechanism 220 used in engine brake 210 is modified as shown in FIG. 3 to permit extra push-in travel of plunger 224 into screw body 222. In addition, upper spring 226 is provided with a preload which allows hydraulic fluid at approximately engine lubricating oil pressure (acting on the bottom 230 of plunger 224 above passageway 64*a*) to lift plunger 224 off the recessed top 68 of slave piston 62. (Upper spring 226 is much weaker than lower spring 232 and cannot by itself compress spring 232.)

By way of additional explanation of the construction and operation of the reset mechanism shown in FIGS. 2 and 3, when the engine brake is off, slave piston return springs 66 push the recessed upper surface 68 of slave piston 62 up against the bottom of screw body 222. This raises plunger 224 slightly from the position shown in FIG. 3 relative to screw body 222. Spring 226 is also then slightly more compressed than is shown in FIG. 3. The bottom 230 of plunger 224 occludes the upper end of passageway 64*a*.

When the engine brake is turned on, hydraulic fluid at approximately engine lubricating oil pressure fills conduits 36 and 38 in FIG. 2 and therefore also fills passageway 64*a/b*. Because of the property of spring 226 mentioned above, the hydraulic fluid in passageway 64*a* is able to lift the bottom of plunger 224 off the recessed top 68 of slave piston 62. This allows hydraulic fluid to flow from passageway 64*a/b* into the MP/SP circuit associated with slave piston 62, thereby filling that circuit as is required to commence reciprocations of the master and slave pistons. When the MP/SP circuit is full, plunger 224 re-closes the upper end of passageway 64*a*.

During each forward stroke of master piston 82, the pressure of the hydraulic fluid in slave piston cylinder 60 is greatly increased. This high pressure hydraulic fluid acts on the upwardly facing surfaces 228*a* and 228*b* of plunger 224, while the downwardly facing lower surface 230 of the plunger continues to see only relatively low pressure hydraulic fluid in passageway 64*a*. Accordingly, there is a net downward hydraulic force on plunger 224 which is sufficient to cause plunger 224 to move down with slave piston 62, thereby compressing spring 232 and keeping the upper end of passageway 64*a* closed.

Shortly after slave piston 62 has opened the exhaust valve(s) 120 in the associated engine cylinder, the pressure in that engine cylinder begins to drop. This causes the hydraulic fluid pressure in slave piston cylinder 60 to drop, thereby decreasing the net downward hydraulic force on plunger 224. Spring 232 is then able to lift plunger 224 off the recessed top 68 of slave piston 62 and to restore plunger 224 to the position relative to screw body 222 that is shown in FIG. 3. As soon as plunger 224 is thus lifted off the top of slave piston 62, high pressure hydraulic fluid can flow from the MP/SP circuit via passageway 64*a/b*. This allows slave piston 62 to reset as described above in connection with FIG. 1. The hydraulic fluid that flows from the MP/SP circuit during this reset operation is accumulated by hydraulic accumulator 240 (FIG. 2). In particular, the plunger 242 of accumulator 240 is raised against the downward force of spring 244 to accumulate this temporarily displaced fluid under plunger 242.

At the end of its reset stroke, slave piston 62 again comes to rest against the lower end of screw body 222. When master piston 82 subsequently performs its return stroke, accumulator 240 refills the MP/SP circuit by forcing the accumulated hydraulic fluid back through passageway 64*a/b*. This refilling hydraulic fluid flow again raises plunger 224 off the top 68 of slave piston 62.

When the engine brake is turned off, the slave piston performs one final downward stroke during which the reset mechanism operates as described above to release hydraulic fluid from the MP/SP circuit. Because conduit 36 is now vented by de-energized solenoid valve 30, the MP/SP circuit is not refilled when master piston 82 would otherwise perform its next return stroke. Accordingly, reciprocation of pistons 82 and 62 ceases and the engine brake stops functioning.

It should be noted that, as compared to FIG. 1, the hydraulic circuitry of FIG. 2 is simplified in several respects. Conduit 50 in FIG. 1 is eliminated in FIG. 2. Complex control valve 40 in FIG. 1 is replaced by much simpler hydraulic accumulator 240 in FIG. 2, and indeed one such accumulator 240 may take the place of two or more control valves 40. (This latter point is discussed in more detail below in connection with FIGS. 5 and 6.) The high pressure leakage that may be present with control valve 40 is eliminated by using accumulator 240 instead.

Although the circuit of FIG. 2 is thus much simpler than the circuit of FIG. 1, all the functionality associated with control valve 40 is preserved in FIG. 2. The MP/SP circuit is filled through passageway 64*a/b* with the cooperation of the modified reset mechanism. The reset mechanism acts as a check valve for isolating the MP/SP circuit from the low pressure circuit (including conduits 36 and 38) until the reset operation begins. The reset mechanism also exhausts the MP/SP circuit via de-energized solenoid valve 30 when engine braking is no longer desired. The minimum oil pressure in the MP/SP circuit is set by the preload force of spring 226. Premature motion of the slave piston is limited to the extent of the amount by which plunger 224 can protrude from screw body 222 prior to the plunger contacting spring 232. During the reset event the displaced hydraulic fluid is temporarily stored in accumulator 240.

Figure 4:
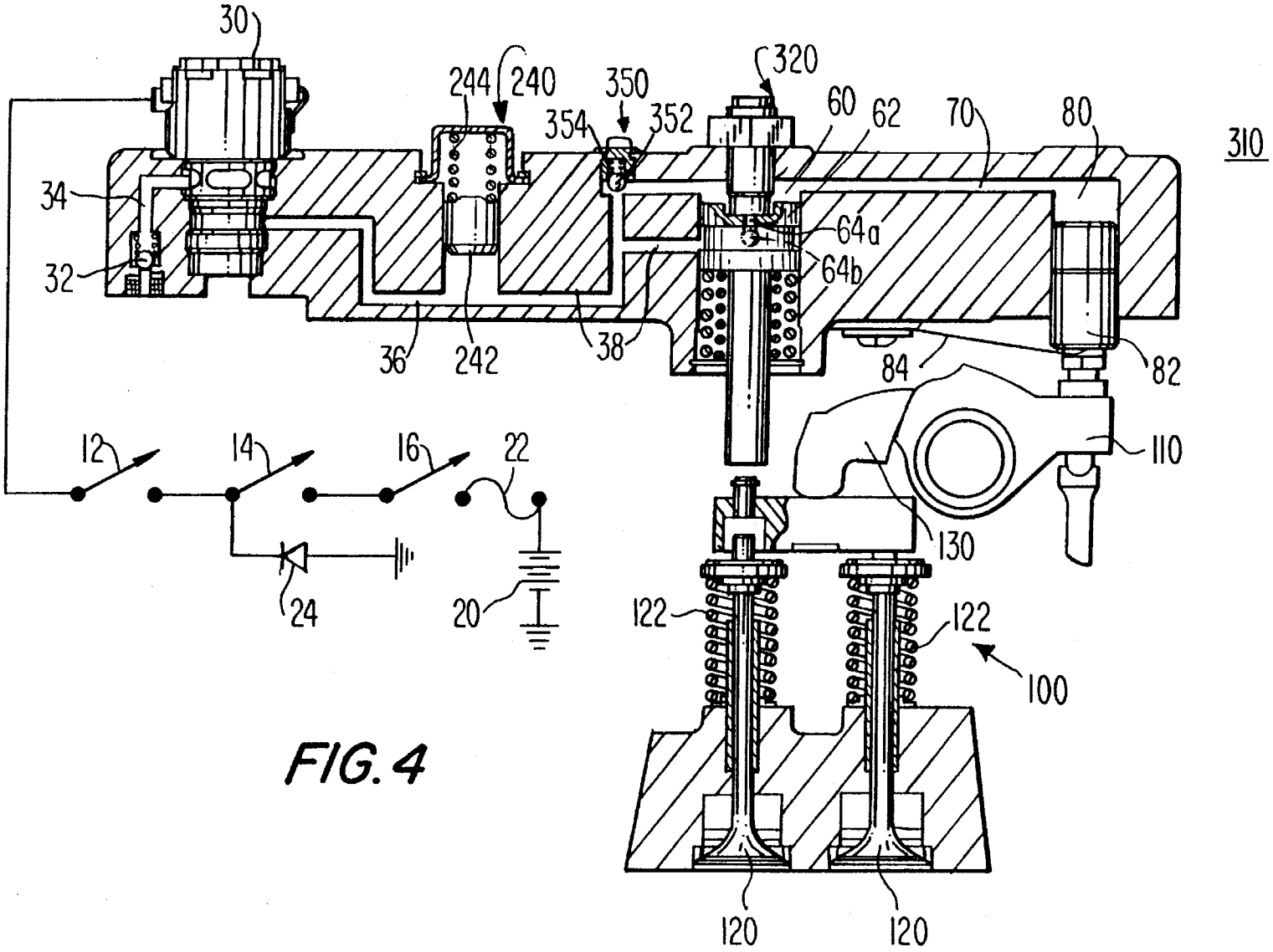
FIG. 4 is another view similar to FIG. 1 illustrating alternative embodiments of the invention.

FIG. 4 shows an alternative embodiment of the invention which is suitable for use when mechanism 320 is a combined reset and automatic lash adjusting mechanism (e.g., as in Meistrick et al. U.S. Pat. No. 4,706,625) or a clip valve mechanism (e.g., as in Hu U.S. Pat. No. 5,201,290). (Again, elements in FIG. 4 that are the same as or substantially similar to elements in any of the above-described FIGS. have the same reference numbers and are not described again in connection with FIG. 4. Only elements that are new or substantially different from previously described elements have new reference numbers (in the 300 series) in FIG. 4.

Because mechanism 320 in FIG. 4 is a combined reset and lash adjusting mechanism or a clip valve mechanism, it is not possible to fill or refill the MP/SP circuit through passageway 64*a/b* because the plunger protrusions of these types of mechanisms 320 is not retractable into the surrounding screw body during the braking cycle. Thus in FIG. 4 the MP/SP circuit is filled or refilled through a separate fill check valve 350 connected between conduit 36 and slave piston cylinder 60 (or any other convenient point in the MP/SP circuit).

Although the complex control valve 40 of FIG. 1 is replaced in FIG. 4 by relatively simple hydraulic accumulator 240 and fill check valve 350, the full functionality of the control valve is again preserved in FIG. 4. Fill check valve 350 provides a passageway for filling the MP/SP circuit. Isolation of the MP/SP circuit occurs when the plunger of mechanism 320 seats over the top of passageway 64*a/b* and fill check valve 350 is closed by circuit pressurization when master piston 82 begins its forward stroke. When engine braking is no longer desired, the MP/SP circuit is exhausted through passageway 64*a/b* and not subsequently refilled because conduit 36 is vented via de-energized solenoid valve 30. Minimum hydraulic fluid pressure for engine brake operation is set by the preload force of the spring 354 acting on the ball 352 of check valve 350. If mechanism 320 is a combined reset and automatic lash adjusting mechanism, premature slave piston motion is limited to the extent of the plunger reset protrusion as described above in connection with FIG. 2. On the other hand, if mechanism 320 is a clip valve mechanism, overall slave piston motion is limited by the clip plunger protrusion. Accumulator 240 accumulates hydraulic fluid that is temporarily displaced from the MP/SP circuit. Again in FIG. 4 a single accumulator 240 may perform the accumulation function for two or more control valves 40 in the engine brake as will now be described in more detail in connection with FIGS. 5 and 6.

FIGS. 5 and 6 illustrate the previously mentioned point that (in connection with other features of this invention) one hydraulic accumulator 240 can serve several MP/SP circuits in an engine brake and thereby eliminate or help to eliminate several complex control valves 40 required in prior art brakes. In the typical prior art engine brake assembly 400 shown in FIG. 5 solenoid valve 30 supplies low pressure hydraulic fluid via conduit 36 to three MP/SP circuits 410*a*, 410*b*, and 410*c*. Each of MP/SP circuits 410 includes a master piston 82*a, b*, or *c*, a Slave piston 62*a, b*, or *c*, and a control valve 40*a, b*, or *c*. Each control valve 40 supplies low pressure hydraulic fluid to the conduit 70*a, b*, or *c* linking the associated master and slave pistons. The hydraulic fluid return conduit 38*a, b*, and *c* from each slave piston 62 is also shown. FIG. 5 makes it clear that in prior art engine brake assembly 400 one relatively complex and expensive control valve 40 is required for each MP/SP circuit.

FIG. 6 shows modification of the apparatus of FIG. 5 in accordance with the present invention. Although FIG. 6 shows MP/SP circuits 510*a*, 510*b*, and 510*c* like the one shown in FIG. 2, it will be apparent to those skilled in the art that MP/SP circuits 510 can alternatively be constructed as shown in FIG. 4. In engine brake assembly 500 one relatively simple hydraulic accumulator 240 in fluid communication with conduit 36 performs the hydraulic fluid accumulation function for all three MP/SP circuits 510*a, b*, and *c*. Slave pistons 62*a, b*, and *c* in FIG. 6 operate as described above in connection with FIG. 2, and the associated FIG. 6 conduits 38*a, b*, and *c* are bi-directional, as is also described above in connection with FIG. 2. In other respects the apparatus of FIG. 6 is like the apparatus of FIG. 5. It will therefore be seen from a comparison of FIGS. 5 and 6 how one hydraulic accumulator 240 can be used in accordance with this invention to help displace several complex control valves 40 in an engine brake.

It will be understood that the foregoing is only illustrative of the principles of the invention and that various modifications can be made by those skilled in the art without departing from the scope and spirit of the invention. For example, reset mechanisms, combined reset and lash adjusting mechanisms, and clip valve mechanisms other than those specifically mentioned above can be used if desired. Concurrently filed, commonly assigned application Ser. No. 315,123, (Docket No. DP-155), also incorporated by reference herein, shows another illustrative combined reset and lash adjusting mechanism that can be used.

The invention claimed is:

1. In a compression release engine brake having a hydraulic circuit that includes a master piston reciprocable in a master piston cylinder in response to a mechanical input from an internal combustion engine associated with the engine brake, a slave piston reciprocable in a slave piston cylinder in response to hydraulic fluid flow in said hydraulic circuit from said master piston cylinder to said slave piston cylinder, and a conduit for supplying hydraulic fluid at a relatively low pressure while operation of the engine brake is desired, the improvement comprising:

means for allowing hydraulic fluid to flow from said conduit through an aperture in said slave piston to said slave piston cylinder whenever hydraulic fluid pressure in said conduit is substantially greater than hydraulic fluid pressure in said slave piston cylinder in order to fill and refill said slave and master piston cylinders with hydraulic fluid.

2. The apparatus defined in claim 1 wherein said means for allowing comprises:

a slave piston reset mechanism for additionally allowing hydraulic fluid to flow from said slave piston cylinder through said aperture in said slave piston to said conduit after said slave piston has reciprocated, in response to hydraulic fluid flow from said master piston cylinder, by an amount sufficient to lower hydraulic fluid pressure in said slave piston cylinder below a predetermined reset value.

3. The apparatus defined in claim 2 wherein said reset mechanism comprises:

a plunger for selectively occluding said aperture in said slave piston by initially travelling with said slave piston from a starting point of the slave piston reciprocation;

a support structure for supporting said plunger so that, at said starting point of the slave piston reciprocation, said plunger can move away from occluding said aperture; and a spring for resiliently urging said plunger to move relative to said support structure toward occluding said aperture when said slave piston is at said starting point of the slave piston reciprocation, said urging being weak enough so that said urging is overcome by hydraulic fluid pressure in said aperture when said slave and master piston cylinders need to be filled or refilled with hydraulic fluid from said conduit.

4. The apparatus defined in claim 2 further comprising:

a hydraulic fluid accumulator for temporarily receiving from said conduit and storing under pressure for subsequent return to said conduit hydraulic fluid substantially equal in volume to the hydraulic fluid that said slave piston reset mechanism allows to flow from said slave piston cylinder.

5. The apparatus defined in claim 4 wherein said slave piston reset mechanism is one of a plurality of similar slave piston reset mechanisms respectively associated with a plurality of slave pistons in said engine brake, and wherein said hydraulic fluid accumulator is a single accumulator for temporarily receiving from said conduit and storing under pressure for subsequent return to said conduit hydraulic fluid substantially equal in volume to the hydraulic fluid that each of said slave piston reset mechanisms allows to flow from the associated slave piston cylinder.

6. The method of operating a compression release engine brake which has a hydraulic circuit that includes a master piston reciprocable in a master piston cylinder in response to a mechanical input from an internal combustion engine associated with the engine brake, a slave piston reciprocable in a slave piston cylinder in response to hydraulic fluid flow in said hydraulic circuit from said master piston cylinder to said slave piston cylinder, and a conduit for supplying hydraulic fluid at relatively low pressure while operation of the engine brake is desired, said slave piston having a selectively openable aperture through which said slave piston cylinder communicates with said conduit when said aperture is opened, said method comprising the step of:

opening said aperture in said slave piston when hydraulic fluid pressure in said slave piston cylinder is substantially less than hydraulic fluid pressure in said conduit so that hydraulic fluid can flow from said conduit through said aperture into said slave piston cylinder in order to fill and refill said slave and master piston cylinders with hydraulic fluid.

7. The method defined in claim 6 further comprising the step of:

opening said aperture in said slave piston after said slave piston has reciprocated, in response to hydraulic fluid flow from said master piston cylinder, by an amount sufficient to lower hydraulic fluid pressure in said slave piston cylinder below a predetermined reset pressure value so that hydraulic fluid can flow from said slave piston cylinder through said aperture to said conduit.

8. The method defined in claim 7 wherein said aperture is selectively closed by a movable plunger which at least initially travels with said slave piston as said slave piston moves from a starting position in response to hydraulic fluid flow from said master piston, wherein said plunger is resiliently urged to close said aperture when said slave piston is in said starting position, and wherein said step of opening said aperture in order to fill and refill said slave and master piston cylinders comprises the step of:

overcoming the resilient urging of said plunger to close said aperture by means of hydraulic fluid pressure in said aperture in order to push said plunger away from said aperture and thereby allow hydraulic fluid to flow out of said aperture into said slave piston cylinder.

9. The method defined in claim 7 further comprising the step of:

temporarily accumulating from said conduit for subsequent return to said conduit an amount of hydraulic fluid substantially equal to the hydraulic fluid which flows from said slave piston cylinder through said aperture to said conduit.

10. A hydraulic circuit for a compression release engine brake comprising:

a housing;

a master piston reciprocable in a master piston cylinder in said housing;

a slave piston reciprocable in a slave piston cylinder in said housing by hydraulic fluid forced by said master piston through a first circuit which connects said master and slave piston cylinders;

a source of hydraulic fluid at a first relatively low pressure;

means for selectively hydraulically connecting said source to said first conduit when engine braking is desired, said means for selectively connecting comprising a second conduit, a first valve for selectively hydraulically connecting said source to said second conduit, and a second check valve mounted directly on said housing and hydraulically connected between said first and second conduits for allowing hydraulic fluid to flow only from said second conduit to said first conduit; and means for venting a portion of the hydraulic fluid from the portion of the hydraulic circuit downstream from said second check valve which includes said first conduit during substantially every reciprocation of said slave piston.

11. The apparatus defined in claim 10 wherein said means for venting comprises:

means for conducting the vented portion of the hydraulic fluid from the vented portion of the hydraulic circuit to said second conduit.

12. The apparatus defined in claim 11 further comprising:

a hydraulic fluid accumulator hydraulically connected to said second conduit but physically separate from said second check valve for receiving from said second conduit and for temporarily storing for subsequent return to said second conduit a quantity of hydraulic fluid substantially equal to said vented portion of the hydraulic fluid.

13. The apparatus defined in claim 12 wherein said means for venting is one of a plurality of similar means for venting that are respectively associated with a plurality of similar slave pistons in said engine brake, and wherein said hydraulic accumulator is a single accumulator for receiving from said second conduit and for temporarily storing for subsequent return to said second conduit a quantity of hydraulic fluid substantially equal to the hydraulic fluid vented by each of said means for venting.

14. The apparatus defined in claim 10 wherein said second check valve comprises:

a seat structure formed in said housing and surrounding a passageway between said first and second conduits; and a closure member movable relative to said seat structure for selectively closing said passageway.

15. The apparatus defined in claim 10 wherein said means for venting comprises:

an aperture through said slave piston through which said first conduit can be hydraulically connected to said second conduit; and means for closing said aperture except when said means for venting is to vent said portion of said hydraulic circuit.

16. The apparatus defined in claim 15 wherein said means for closing said aperture is responsive to a difference between hydraulic fluid pressure in said first and second conduits by closing said aperture until hydraulic fluid pressure in said first conduit drops to a point that it is less than the sum of hydraulic fluid pressure in said second conduit plus a predetermined differential factor.

17. The apparatus defined in claim 15 wherein said means for closing said aperture is responsive to the amount of travel of said slave piston by closing said aperture until said slave piston has travelled a predetermined distance in response to hydraulic fluid flow from said master piston cylinder to said slave piston cylinder.

18. A hydraulic circuit for a compression release engine brake comprising:

a master piston reciprocable in a master piston cylinder;

a slave piston reciprocable in a slave piston cylinder by hydraulic fluid forced by said master piston through a first conduit which connects said master and slave piston cylinders;

a source of-hydraulic fluid at a first relatively low pressure;

means for selectively hydraulically connecting said source to said first conduit when engine braking is desired, said means for selectively connecting comprising a second conduit, a first valve for selectively hydraulically connecting said source to said second conduit, and a second check valve hydraulically connected between said first and second conduits for allowing hydraulic fluid to flow only from said second conduit to said first conduit;

means for venting a portion of the hydraulic fluid from the portion of the hydraulic circuit downstream from said second check valve which includes said first conduit during substantially every reciprocation of said slave piston, said means for venting including means for conducting the vented hydraulic fluid to said second conduit; and a hydraulic fluid accumulator hydraulically connected to said second conduit for receiving from said second conduit and for temporarily storing for subsequent return to said second conduit a quantity of hydraulic fluid substantially equal to said vented hydraulic fluid, said hydraulic fluid accumulator being physically separate from said second check valve.

19. The apparatus defined in claim 18 wherein said means for venting is one of a plurality of similar means for venting that are respectively associated with a plurality of similar slave pistons in said engine brake, and wherein said hydraulic fluid accumulator is a single accumulator for receiving from said second conduit and for temporarily storing for subsequent return to said second conduit a quantity of hydraulic fluid substantially equal to the hydraulic fluid vented by each of said means for venting.

* * * * *